United States Patent [19]

Blake, Jr.

[11] 3,974,886

[45] Aug. 17, 1976

[54] DIRECTIONAL DRILLING TOOL

[76] Inventor: Jack L. Blake, Jr., Eastman-Whipstock, Box 567, Dubai, United Arab Emirates

[22] Filed: Feb. 27, 1975

[21] Appl. No.: 553,506

[52] U.S. Cl. ..... 175/76; 175/269

[51] Int. Cl.[2] ..... E21B 7/06; E21B 9/26

[58] Field of Search ..... 175/76, 61, 268, 269; 166/154

[56] References Cited

UNITED STATES PATENTS

| | | | |
|---|---|---|---|
| 1,921,135 | 8/1933 | Santiago | 175/269 |
| 2,142,559 | 1/1939 | Duus | 175/61 |
| 2,170,452 | 8/1939 | Grant | 175/268 |
| 2,659,438 | 11/1953 | Schnitter | 166/154 |
| 2,686,660 | 8/1954 | Storm | 175/61 |
| 2,891,769 | 6/1959 | Page, Sr. et al. | 175/76 |
| 3,092,188 | 6/1963 | Farris et al. | 175/76 |
| 3,424,256 | 1/1969 | Jeter et al. | 175/76 |
| 3,572,450 | 3/1971 | Thompson | 175/76 |
| 3,593,810 | 7/1971 | Fields | 175/76 |

*Primary Examiner*—James A. Leppink
*Attorney, Agent, or Firm*—Huebner & Worrel

[57] ABSTRACT

A tool adapted to be mounted on an elongated fluid conductive assembly such as a drill string for performance of a predetermined work operation at a remote location, such as the directional control of drilling, the tool having a tool body borne by the fluid conductive assembly for positioning in the remote location; a work member mounted on the tool body for movement laterally thereof; and a cam member received in the tool body in engagement with the work member for movement longitudinally in the tool body to move the work member laterally of the tool body upon predetermined pressurization of the fluid conductive assembly.

14 Claims, 11 Drawing Figures

DIRECTIONAL DRILLING TOOL

BACKGROUND OF THE INVENTION

The present invention relates to a directional drilling tool utilizing a drill string in a borehole and more particularly to such a tool wherein borehole deviation with respect to the vertical can be controlled to increase, decrease, or maintain the angle of such deviation without removal of the drill string from the borehole.

The technology developed with respect to drilling boreholes in the earth has long encompassed the use of various techniques and tools to control the deviation of boreholes during the drilling operation. In some instances such technology is employed to retard borehole deviation. In other instances increased directional deviation is desired. However, in virtually all instances it has heretofore been necessary to withdraw the drill string assembly from the borehole for the attachment of various specialized tools to achieve the desired objective. The prior art represented by such patents as the Page, Sr., et al. U.S. Pat. No. 2,891,769; the Farris et al. U.S. Pat. No. 3,092,188; the Fields U.S. Pat. No. 3,593,810; the Storm U.S. Pat. No. 2,686,660 and the Jeter et al. U.S. Pat. No. 3,424,256 evidence such operational limitations.

Drilling operations, particularly in petroleum exploration, are commonly carried out at great depths frequently reaching several thousand feet below the earth's surface. Since a drill string is composed of a multiplicity of sections of drill pipe which must successively be disassembled upon removal from the borehole, the removal of the drill string from the borehole for the attachment of directional tools at the remote end of the drill string in an extremely time consuming and thus expensive operation. Such procedures often entail several days of work. This "down time" is extremely expensive and a significant factor in the determination of the economic feasibility of exploratory drilling. The problem becomes chronic where, as is frequently the case, it is necessary to change the angle of borehole deviation several times requiring such considerable "down time" in each instance.

Therefore, it has a long been recognized that it would be desirable to have a directional drilling tool adapted for incorporation in a drill string individually or in any desired combination and capable of remaining inactive so as not to impede normal drilling operations, but subject to being activated to the extent desired without removal of the drill string from the borehole and which subsequently can similarly be deactivated without removal of the drill string from the borehole.

SUMMARY OF THE INVENTION

In view of the foregoing, it is an object of the present invention to provide an improved directional drilling tool for drilling in the earth.

Another object is to provide such a drilling tool which can be incorporated in a drill string and selectively actuated without removal of the drill string from the borehole.

Another object is to provide such a drilling tool which can be employed dependably to maintain an angle of borehole deviation.

Another object is to provide such a drilling tool which can selectively be employed to increase or decrease an angle of borehole deviation.

Another object is to provide such a drilling tool which utilizes the weight of the drill string in a deviated borehole to pivot the drill bit borne by the drill string about a fulcrum point so as to increase, maintain or decrease the angle of borehole deviation.

Another object is to provide such a drilling tool which can be left in position in the drill string in a nonoperational configuration without detracting in any respect from the normal operation of the drill string and drill bit.

Another object is to provide such a drilling tool which is adapted for operation in pairs or larger combinations in a drill string for selective operation to provide the ever present capability for control of borehole deviation.

Another object is to provide such a drilling tool which eliminates the protracted and expensive "down time" associated with the use of conventional directional drilling tools.

A further object is to provide such a drilling tool which requires no auxiliary or supporting equipment not otherwise required in drilling operations so as to afford a facility of use not commonly achieved in conventional directional drilling tools.

Still further objects and advantages are to provide improved elements and arrangements thereof in a tool for the purposes described which is dependable, economical, durable and fully effective in accomplishing its intended purposes.

DESCRIPTION OF THE PREFERRED EMBODIMENT

Figures 1, 8, 11:
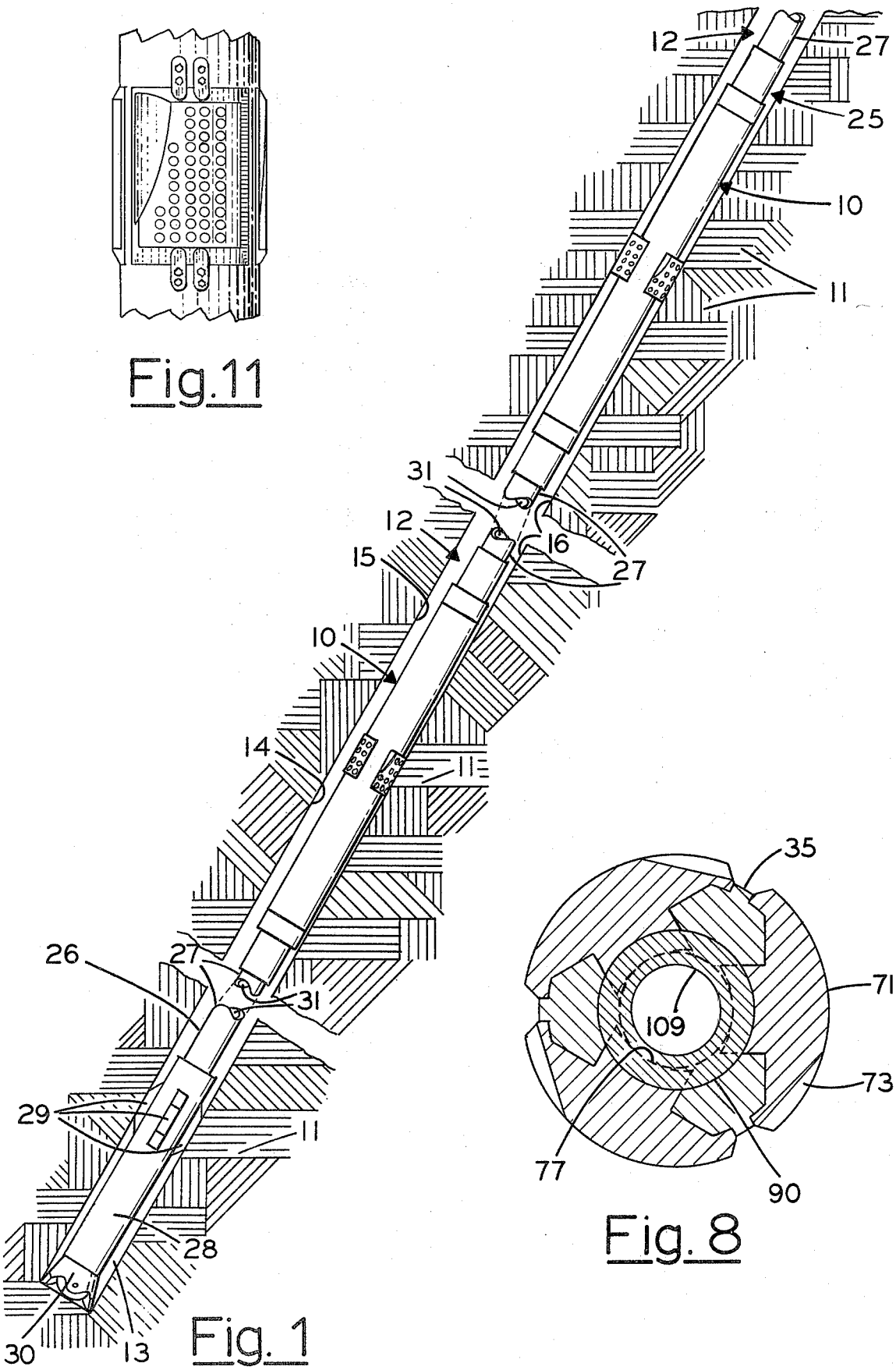
FIG. 1 is a fragmentary side elevation of a pair of directional drilling tools embodying the principles of the present invention incorporated in a drill string disposed within a borehole.
FIG. 8 is a somewhat enlarged transverse section taken at a position indicated by line 8—8 in FIG. 2.
FIG. 11 is a fragmentary side elevation of the drilling tool.

Referring more particularly to the drawings, the directional drilling tool of the present invention is generally indicated by the numeral 10 in FIG. 1. As shown, as subsurface formation is fragmentarily represented at 11 lying at depth beneath the earth's surface, not shown. A borehole 12 has been bored into the formation and is deviated from true vertical for illustrative convenience at an angle of approximately 30° from the vertical and has a lower end portion 13. The borehole has a side wall 14. Since the borehole is deviated from true vertical, as shown in FIG. 1, the side wall has an upper surface 15 and an opposed lower surface 16 constituting opposite sides of the borehole.

A drill string assembly 25 is extended through the borehole 12. The assembly has a remote portion extending to the lower end portion 13 of the borehole, as shown in FIG. 1. The assembly is composed of endwardly interconnected drill pipe 27 extending from a drill rig, not shown, on the earth's surface down the borehole to the area illustrated in FIG. 1. It should be noted that the distance between the earth's surface and the area illustrated in FIG. 1 may often be many thousand feet. The significance of this will subsequently become more clearly apparent.

The drill string assembly 25 can be assembled in any desired configuration suitable for the drilling operation to be performed. As shown in FIG. 1 for illustrative convenience, the assembly mounts a directional drilling tool 10 of the present invention followed by a section of drill pipe of suitable length, followed by a second drilling tool 10. Another section of drill pipe of suitable length is borne by the second drilling tool followed by a conventional stabilizer 28, having laterally extending guides 29 borne thereby and extending to a diameter approximating that of the borehole. A conventional drill bit 30 is mounted on the downwardly extending end of the conventional stabilizer for performance of the boring operation upon rotation of the drill string assembly 25 in the conventional fashion.

As will subsequently become more clearly apparent, the entire drill assembly 25 including the interconnected drill pipe 27, drilling tools 10, conventional stabilizer 28, and drill bit 30 has a fluid conductive passage 31 extending therethrough. In the conventional manner, during operation of the drill string assembly, drilling fluid or "mud" is pumped down the passage of the drill string assembly, through the drill bit 30 and then upwardly about the drill string assembly externally thereof to the earth's surface for recovery. Drilling fluid is a composition of water, clays and chemicals employed for various purposes including lubricating and cooling the drill bit and transporting the cuttings of the bit to the surface. Another important function is to prevent "blow outs", in the event a reservoir of petroleum under pressure is pierced, by pumping the fluid down the assembly under great pressure. The significance for the directional drilling tool 10 of the present invention is that drilling operations commonly maintain equipment for pumping drilling fluid down the interior of the drill string assembly and that such equipment is capable of maintaining the fluid under a selected pressure of a considerable and controlled magnitude.

Figure 2:
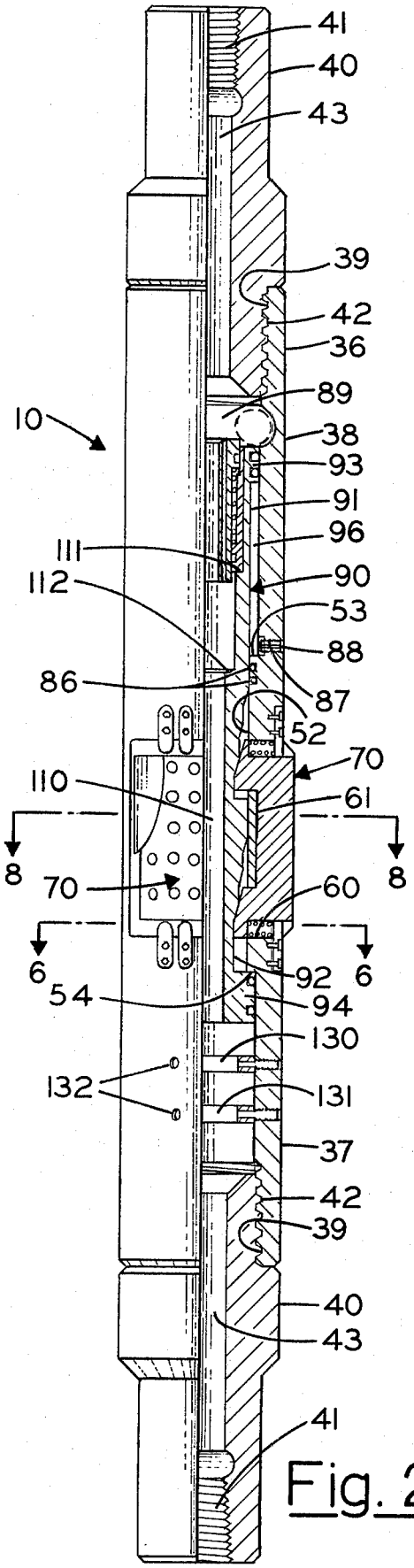
FIG. 2 is a somewhat enlarged quarter sectional view of a directional drilling tool of the present invention.

Referring more particularly to FIG. 2, a single directional drilling tool 10 of the present invention is shown having a substantially cylindrical tool body 35. The tool body has an upper end portion 36 and a lower end portion 37 with a substantially cylindrical exterior surface 38. The upper and lower end portions of the tool body have internal screw-threads 39. For purposes of connection of the tool to drill pipe 26 so as to incorporate the tool in a drill string assembly 25, a pair of couplings 40 are individually attached to the upper and lower end portions of the tool body. Each coupling has an internally screw-threaded portion 41 and an externally screw-threaded portion 42 interconnected by an axial passage 43. The externally screw-threaded portions 42 of the couplings are individually screw-threadably received in the internal screw-threads 39 of the upper and lower end portions of the tool body.

The tool body 35 has a substantially cylindrical internal surface 50 defining an axial passage 51 interconnecting the axial passages 43 of the couplings 40. The tool body has a constricted cylindrical surface 52 internally and substantially centrally thereof defining an upper ledge 53 and a lower ledge 54 where it meets the internal surface 50.

The exterior surface 38 of the tool body 35 is recessed at three transversely symmetrical positions substantially radially of the constricted cylindrical surface 52 to define individual plate receptacles 60. Each receptacle is inwardly bounded by a back surface 61 forming an integral part of the tool body. An upper arm passage 62 and a lower arm passage 63 are extended through the back surface of each receptacle at the opposite ends thereof.

Figure 6:
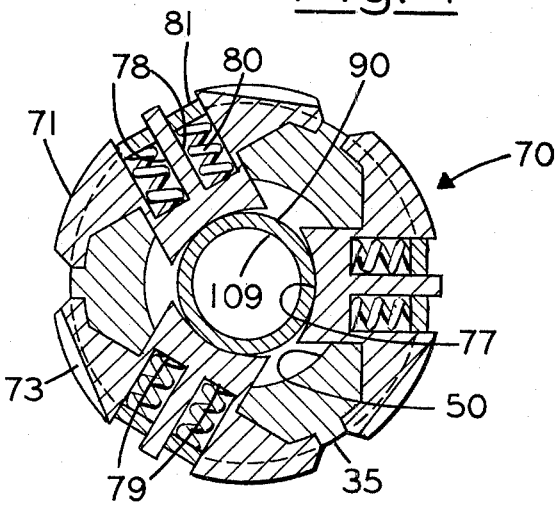
FIG. 6 is a somewhat enlarged transverse section taken at a position indicated by line 6—6 in FIG. 2.
Figure 7:
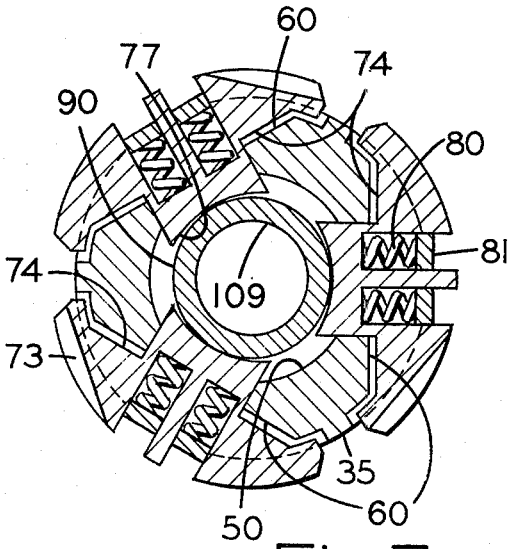
FIG. 7 is a transverse section taken at a position indicated by line 7—7 in FIG. 5.

A pressure plate 70 is mounted within each plate receptacle 60 for slidable movement along paths radially extending from the tool body 35 between the retracted position shown in FIG. 6 and the extended position shown in FIG. 7. Each pressure plate has an exterior wear surface 71 of suitable design such as that shown in FIGS. 2 and 5 wherein a plurality of carbide wear pads 72 are mounted on the wear surface and the surface has a scalloped or recessed portion 73. Each of the pressure plates has a back surface 74 which is adapted for mating engagement with the back surface 61 of its respective receptacle 60.

Figure 5:
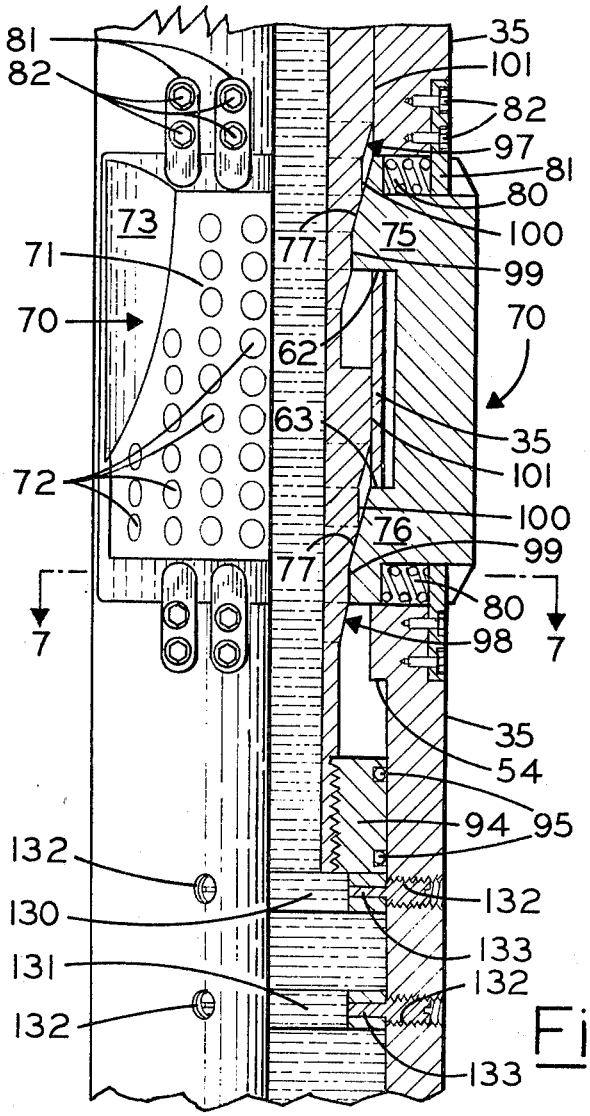
FIG. 5 is a fragmentary quarter sectional view of a portion of the drilling tool.

An upper arm 75 and a lower arm 76 are mounted on and extended from the back surface 74 of each pressure plate 70 spaced and dimensioned for individual, slidable receipt in the upper and lower arm passages 62 and 63 of their respective receptacle. The upper and lower arms have inwardly facing cam surfaces 77. Each of the arms has a pair of spring passages 78 disposed in side-by-side relation extending from the wear surface 71 of their respective plate inwardly to positions terminating adjacent to but outwardly of the cam surface 77 to define spring engaging walls 79 between the passages and the cam surface. A spring 80 is received in each spring passage 78 in engagement with its respective spring engaging wall 79. The pressure plates are retained in position on the tool body 35 within their respective plate receptacles 60 by four lock plates 81 individually extended from the tool body into the spring passages individually to capture their respective springs within the passages between the lock plates and walls 79, as best shown in FIG. 5. The lock plates are mounted in the described positions by bolts 82 screw-threadably extended through the plates and into the tool body. Thus, the pressure plates are retained in position by the lock plates and springs urging the pressure plates into the retracted positions shown in FIG. 6.

Figure 10:
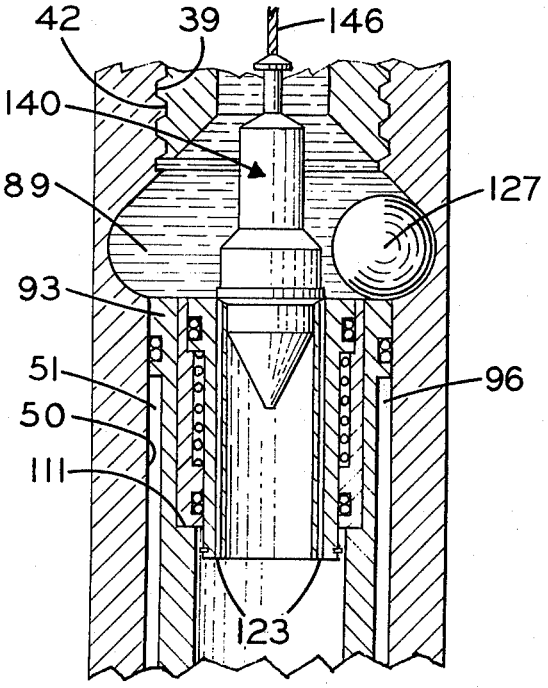
FIG. 10 is a fragmentary longitudinal section of the drilling tool showing the sealing member in position.

A pair of O-rings 86 are mounted in the tool body extending concentrically about the constricted cylindrical surface 52 adjacent to and below the upper ledge 53, as shown in FIG. 2. An internally screw-threaded bore 87 is provided in the tool body adjacent to and above the upper ledge. A screw-threaded removable plug 88 is screw-threadably received in the bore. The upper portion 36 of the tool body 35 has an annular ball receptacle 89 disposed between the internal surface 50 thereof and the internal screw-threads 39 of the upper end portion, as best shown in FIGS. 2 and 10.

A cam member or sleeve 90 is slidably received within the axial passage 51 of the tool body 35. The sleeve has an upper end portion 91 and an opposite lower end portion 92. The upper end portion mounts an integral, upper radial flange 93 and the lower end portion mounts an integral lower radial flange 94. The flanges 93 and 94 have the same diameter adapted for slidable movement within the internal passage 50 between a retracted position, shown in FIG. 2, wherein the lower radial flange engages the lower ledge 54 and the upper radial flange is positioned immediately below the ball receptacle 89, and an advanced position subsequently to be described. Each of the flanges 93 and 94 mounts a pair of O-rings 95 providing sealed engagement with the internal surface 50 of the tool body 35. The upper radial flange, the sleeve, the upper ledge 53 and the internal surface 50 define a compression chamber 96 circumscribing the upper end portion of the sleeve. The compression chamber is adapted to receive a suitable gas, such as nitrogen monoxide ($N_2O$), maintained at a pressure sufficient to retain the cam member in the retracted position. The screw-threaded plug 88 can be removed for pumping of the gas into the chamber through the screw-threaded bore 87. Alternatively, a compression spring, not shown, of appropriate resiliency can be mounted in the compression chamber extending concentrically about the cam member.

The sleeve 90 has an upper cam surface 97 and a lower cam surface 98 circumscribing the sleeve in predetermined spaced relation to each other and in juxtaposition to the constricted cylindrical surface 52 of the tool body 35. Each of the cam surfaces has corresponding lower or first steps 99, middle or second steps 100 and upper or third steps 101. The steps have corresponding predetermined diameters increasing from first to third. As can best be seen in FIG. 5, corresponding steps are spaced a distance corresponding to the spacing of the upper and lower arms 75 and 76 respectively of the pressure plates 70 so that the cam surfaces 77 thereof are maintained by the springs 80 in engagement with corresponding steps of the cam surfaces 97 and 98.

Figure 3:
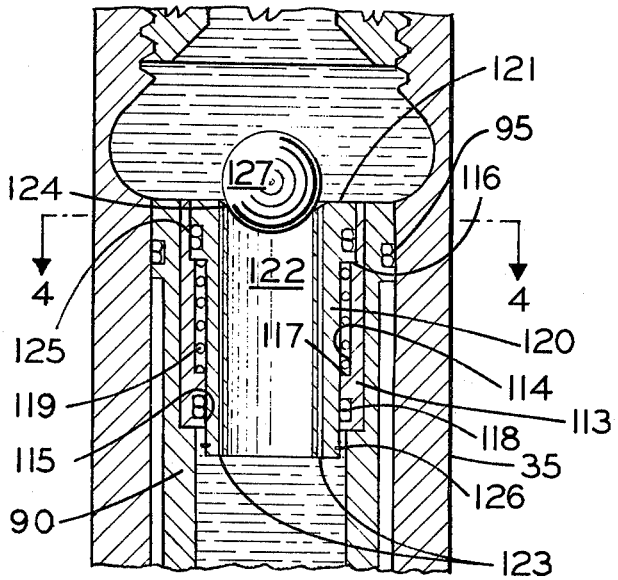
FIG. 3 is a somewhat further enlarged fragmentary longitudinal section of a portion of the drilling tool viewed in FIG. 2.

The cam sleeve 90 has a substantially cylindrical internal surface 109 defining a passage 110 extending axially through the sleeve and forming a first ledge 111 and a second ledge 112 in spaced relation within the upper end portion 91 of the sleeve. A guide ring 113 is mounted, as by welding, within the passage 110 at the upper end portion of the sleeve abutting the first ledge 111, as shown in FIG. 3. The guide ring has an internal surface 114 defining a substantially cylindrical passage 115 extending therethrough in axial alignment with passage 110. The internal surfaces inwardly stepped to define an orifice plate seat 116 and a spring seat 117. A pair of O-rings 118 are mounted on the guide ring extending about the passage below the spring seat. A compression spring 119 is received in the passage in rested engagement with the spring seat 117.

Figure 4:
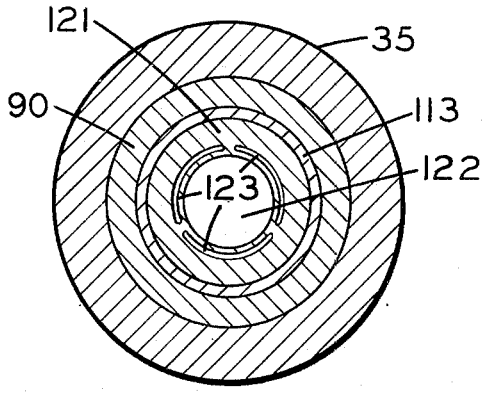
FIG. 4 is a transverse section taken at a position indicated by line 4—4 in FIG. 3.

A reciprocal member 120, having a integral orifice plate 121 at one end thereof is received in the guide ring 113 inwardly of the compression spring 119 so as to capture the spring between the orifice plate thereof and the spring seat 117. The reciprocal member has a central passage 122 extending axially through the reciprocal member. Three transversely arcuate peripheral passages 123 are provided in and extended through the reciprocal member outwardly adjacent to the central passage, as best shown in FIG. 4. The orifice plate is sloped onto the central and peripheral passages to define a ball seat 124 of a predetermined configuration and diameter. A pair of O-rings 125 are mounted on the reciprocal member circumscribing the orifice plate. A stop ring 126 is secured concentrically about the reciprocal member remote from the orifice plate in a position extending laterally therefrom so as to engage the guide ring to limit further vertical movement of the reciprocal member within the guide ring.

As shown in FIG. 3, an article or ball 127 of a diameter suitable for seating in the ball seat 124 of the orifice plate 121 is adapted to be employed with the tool 10 as will subsequently be described. The ball may be constructed of any suitable material, such as Bakelite or other plastic material.

A first barrier ring 130 and a second barrier ring 131 are mounted in spaced relation on the internal surface 50 of the tool body 35 between the lower ledge 54 and the internal screw-threads 39 of the lower end portion 37 thereof, as best shown in FIG. 2. A plurality of screw-threaded bores 132 extend through the tool body and screw-threadably mount shear pins 133 which support the barrier rings in their respective positions. The shear pins of the first barrier ring are adapted to withstand a predetermined transverse force before shearing to free the first barrier ring. Similarly, the shear pins of the second barrier ring are adapted to withstand a transverse force of a predetermined magnitude greater than that of the shear pins of the first barrier ring. For example, the shear pins of the first barrier ring cooperatively may be designed to withstand 15,000 pounds pressure and those of the second barrier ring 60,000 pounds pressure.

Figure 9:
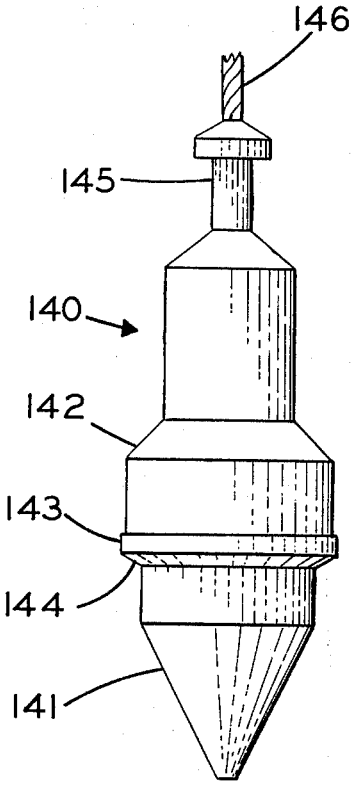
FIG. 9 is a side elevation of a sealing member of the present invention.

Shown in FIGS. 9 and 10 is a blank off plug 140. The plug has a forward portion 141, preferably constructed of brass, and an integral weight portion 142. The forward portion is circumscribed adjacent to the weight portion by laterally extending resilient sealing ring 143 having a sealing surface 144 sloped for sealing engagement with the ball seat 124. The plug has a rearward portion 145 to which is attached a wire retrieving line 146.

OPERATION

The operation of the described embodiment of the subject invention is believed to be clearly apparent and is briefly summarized at this point. As previously noted, the directional drilling tool 10 of the present invention is adapted to be employed singly or in multiples in a variety of combinations as an integral part of a drill string assembly 25. One such combination is fragmentarily illustrated in FIG. 1 wherein a pair of drilling tools 10 are mounted in the drilling string assembly 25. The tools are mounted on the assembly, as previously described, interconnected by sections of drill pipe 27 secured to the couplings 40 at the opposite end portions 36 and 37 of each tool. A conventional stabilizer 28 is mounted below the tools 10 and in turn mounts the drill bit 30. In the representative assembly 25 shown in FIG. 1, the drill bit 30 may be, for example, 12¼ inches in diameter, the outer diameter defined by the guides 29 of the conventional stabilizer 28 may be 12¼ inches in diameter. The tools 10 may be expandable from a contracted diameter of 10¾ inches about the pressure plates to an expanded diameter of 12¼ inches. The spacing between the conventional stabilizer 28 and the pressure plates 70 of the lowermost drilling tool 10 may be approximately 25 feet. Similarly, the distance between the pressure plates 70 of the lowermost drilling tool and the pressure plates of the uppermost drilling tool may be approximately 25 feet. It must be emphasized, however, that the described configuration and dimensions are provided for illustrative convenience. The spacing between the tools as well as the various diameters involved may be of any suitable distance and size.

The borehole 12, shown in FIG. 1, has been deviated, intentionally or otherwise, to an angle of approximately 30° with respect to true vertical. As previously noted, a drill string assembly 25 incorporating the directional drilling tools 10 of the present invention can be operated with tools in their contracted configurations, as shown in FIG. 6, without detracting from the normal operation of the assembly. During such normal operation, the assembly is rotated with the weight exerted downwardly against the drill bit 30 and lower portion of the drill string assembly often being in the neighborhood of 40 to 50 thousand pounds. Under this weight and with the combined effect of gravitational pull as a result of deviation of the borehole, conventional directional drilling technology teaches that the portion of the drill string assembly within the lower end portion 13 of the borehole rests against the lower surface 16 of the borehole. The guides 29 of the conventional stabilizer 28, engaging the side wall 14 of the borehole 12, act as a fulcrum for the drill string assembly. Thus, the weight of the assembly above the conventional stabilizer pivots the axis about which the drill bit is rotated about the fulcrum point provided by the conventional stabilizer thereby urging the drill bit toward greater lateral deviation during the drilling operation, as can be seen in FIG. 1.

It is known in conventional directional drilling technology that maintenance or reduction of the angle of borehole deviation can be accomplished by incorporating a conventional stabilizer 28 having a diameter greater than that of the drill pipe 27 in the assembly 25 above the stabilizer adjacent to the bit so as to raise the axis of the assembly higher above the lower surface 16 of the borehole. Thus, the axis of the drill bit is pivoted about the fulcrum provided by the lowermost stabilizer to reduce borehole deviation. However, as previously noted, this operation requires removal of the entire assembly from the borehole. This problem is avoided with the directional drilling tool 10 of the present invention since removal of the assembly 25 is not required in order to adjust the angle of the axis of rotation of the drill bit.

As previously noted, the central passages 122 of the orifice plates 121 of the tools 10 are of different diameters. The diameter of the passage of the lowermost tool is of a smaller diameter than that of the uppermost tool. Thus, if it is desired to activate the lowermost tool, its respective ball 127 is inserted in the drill string assembly at the earth's surface and pumped under pressure of the drilling fluid through the drill pipe 26, the uppermost drilling tool 10 and into respective ball seat 124 of the lowermost tool. Regardless of the depth at which the drilling tool is positioned, fluid pressure at the surface will increase upon receipt of the ball within the ball seat 124 so as to indicate when the ball has reached its desired position.

Thereafter, upon increasing the fluid pressure of the drilling fluid against the ball 127 and its respective orifice plate 121, the reciprocal member 120 slides downwardly against compression of the spring 119 thereby similarly urging the cam sleeve 90 downwardly within its respective tool body 35 and against the resiliency of the gas received in the compression chamber 96. Experience indicates the required pressure to move the cam sleeve to the desired position within the tool body. However, the first barrier ring 130 prevents movement of the cam sleeve beyond the desired point in view of the significantly greater fluid pressure required to shear the shear pins 33 thereof. Thus, the cam sleeve is motivated to position the first steps 99 of the upper and lower cam surfaces 97 and 98 respectively in engagement with the cam surfaces 77 of the upper and lower arms 75 and 76 respectively of the pressure plates 70.

Thus, the pressure plates 70 are forced outwardly against pressure of the springs 80 to extended positions intermediate the fully retracted positions shown in FIG. 6 and the fully expanded positions shown in FIG. 7. It will be seen that if the lowermost directional drilling tool 10 is expanded by means of lateral movement of the pressure plates 70, the tool continues to rest on the lower surface 16 of the side wall 14 of the borehole 12, but the axis of rotation of that portion of the drilling tool will be moved somewhat further toward the axis of the borehole thereby pivoting the drill bit 30 about the fulcrum defined by the conventional stabilizer 28 so as to lower the rate of deviation of the borehole.

When the desired expansion of the selected tool 10 has been achieved, the predetermined fluid pressure is maintained against the ball 127 and orifice plate 121 to maintain the desired expansion of the tool. Normal drilling is continued during this operation with the drilling fluid required for the drilling operation passing through the peripheral passages 123 of the reciprocal member 120.

Further expansion of a drilling tool 10 is accomplished through the use of the blank off plug 140, shown in FIG. 9. Initially, fluid pressure is reduced so as to permit the cam sleeve 90 to return to the retracted position shown in FIG. 2. The reduction in pressure similarly causes the compression spring 119 rapidly to return the reciprocal member 120 to its retracted position thereby expelling the ball 127 from its ball seat 124. Because of the angle of deviation of the borehole 12, the ball, having been discharged from the ball seat, is gravitationally received within the ball receptacle 89, as shown in FIG. 10. Thereafter, the blank off plug 140 is pumped on its wire retrieving line 146 to seat in the central passage 122 of the reciprocal member 120 of the selected tool with the sealing surface 144 in engagement with the peripheral passages 123 so as completely to obstruct the path of fluid flow through the tool. Subsequently, fluid pressure is exerted against the cam sleeve 90 and the blank off plug and increased until the predefined shear pressure of the shear pins 133 of the first barrier ring 130 is reached. Thus, the shear pins are sheared. The first barrier ring 130 is forced downwardly into rested engagement with the second barrier ring 131.

Subsequently, fluid pressure is reduced and the blank off plug 140 is retrieved from the drill string assembly 25 by its retrieving line 146. Fluid pressure is then again increased which causes the ball 127 to be drawn from the ball receptacle 89 and to seat in the ball seat 124. Predetermined fluid pressure is then exerted against the ball and orifice plate 121 to cause the pressure plates 70 to be expanded by the increment desired, as previously described, by motivating the first or second steps into engagement with the cam surfaces 77 as desired.

Futher expansion of the pressure plates 70 of the selected tool 10 is accomplished similarly by exerting sufficient pressure against the blank off plug to shear the pins 133 of the second barrier ring 131 thereby freeing the cam sleeve to position the third steps 101 of the upper and lower cam surfaces 97 and 98 respectively in engagement with the cam surfaces 77 of the pressure plates 70. The ball 127 of either or both tools can be retrieved in a manner similar to that described for the blank off plug by use of a suitable retrieving line, not shown. Alternatively, either or both of the balls can be left in position in their respective ball receptacles 89.

The tools 10 are adapted for repeated use in a variety of combinations. Upon removal of a drill string assembly 25 from a borehole 12, the tools can be disconnected and employed in new combinations. The first and second barrier rings 130 and 131 respectively can be remounted in their described operational positions by the use of new shear pins 133. It should also be noted that a tool 10 of the present invention can be used in place of the conventional stabilizer 28 of the assembly 25 shown in FIG. 1 if desired.

Therefore, it can be seen that the directional drilling tool of the present invention is fully compatible with normal operation of a conventional drill string assembly and is available for operation from the earth's surface at the time and to the extent that the directional engineer requires by simply selectively operating the drilling tools for increasing, decreasing or maintaining the angle of borehole deviation without requiring removal of the entire drill string assembly from the borehole so as to avoid the protracted and exorbitantly expensive down time encountered in conventional directional drilling operations.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A directional drilling tool adapted for use on a fluid conductive drill string having a remote end mounting a drill bit and an opposite upper end portion, the tool comprising a tool body, having an internal receptacle at a predetermined position, adapted to be mounted on the drill string in substantially coaxial alignment therewith spaced from the drill bit in the direction of the upper portion of the drill string; a work member mounted on the tool body for selected movement laterally of said tool body for engagment with the wall of a borehole within which the drill string is received; a fluid conductive reciprocal member mounted within said tool body for movement substantially axially thereof and having an exterior cam surface in engagement with the work member internally of the tool body and a seat at the end thereof remote from the drill bit adjacent to the internal receptacle; and means for selective receipt in said seat in obstructing relation to fluid under a predetermined pressure conducted through the drill string to cause movement of the reciprocal member toward said drill bit within the tool body whereby the work member is moved laterally from said tool body and for gravitational movement from the seat and into said receptacle when fluid pressure is reduced below said predetermined pressure.

2. The tool of claim 1 wherein the cam surface of the reciprocal member has portions sloped in increments of increasing lateral distance from the axis of the reciprocal member in the direction of the seat whereby greater fluid pressure exerted against the reciprocal member produces greater lateral extension of the work member.

3. The tool of claim 2 wherein the tool body mounts means for limiting movement of the reciprocal member toward the drill bit beyond a predetermined position in the tool body until a predetermined fluid pressure is applied to said reciprocal member.

4. A directional drilling tool adapted for use on a fluid conductive drill string having a remote end mounting a drill bit and an opposite upper end portion, the tool comprising a tool body, having an internal receptacle located in a predetermined position, adapted to be mounted on the drill string in substantially coaxial alignment therewith spaced from the drill bit in the direction of the upper portion of the drill string; a work member mounted on the tool body for selected movement laterally of said tool body for engagement with the wall of a borehole within which the drill string is received; a fluid conductive reciprocal member mounted within said tool body for movement substantially axially thereof and having an exterior cam surface in engagement with the work member internally of the tool body and a seat at the end thereof remote from the drill bit, said cam surface being composed of portions sloped in increments of increasing lateral distance from the axis of the reciprocal member in the direction of the seat thereof whereby greater fluid pressure exerted against the reciprocal member produces a corresponding greater lateral extension of the work member and said reciprocal member being fluid conductive by means of a first passage extending substantially axially therethrough in communication with the seat and by means of a second passage by passing said seat; first resilient means interconnecting the tool body and the work member urging said work member into a retracted position in the tool body in engagement with the cam surface; second resilient means interconnecting the tool body and the reciprocal member urging said reciprocal member into a predetermined retracted position; and a substantially spherical ball dimensional for selective receipt in said seat of the reciprocal member in obstructing relation to fluid conducted through the drill string permitting selective pressurization against said ball and reciprocal member while simultaneously permitting fluid to be conducted to the drill bit through said second passage for continued operation of the drill string, said internal receptacle of the tool body being laterally adjacent to the seat of the reciprocal member for gravitational receipt of the ball when fluid pressure is reduced.

5. The tool of claim 4 wherein the tool body mounts means for limiting movement of the reciprocal member toward the drill bit beyond a predetermined position in the tool body controlling lateral extension of the work member until a predetermined fluid pressure is exerted on said reciprocal member and a sealing member is adapted selectively to be lowered through the drill string to engage the reciprocal member in sealing relation to the first and second passages to permit creation of said predetermined fluid pressure.

6. The tool of claim 5 wherein the limiting means includes a barrier secured within the path of movement of the tubular member by pins adapted to shear at said predetermined fluid pressure.

7. The tool of claim 6 wherein a pair of said tools is mounted on the drill string, the reciprocal members of said tools having seats and first passages of different diameters and the tool having the first passage of greater diameter mounted on the drill string above the other tool whereby the tools can be operated alternatively by inserting a ball adapted to be received in the seat of the desired tool.

8. The tool of claim 7 wherein the reciprocal member of each tool has a plate defining its respective seat, said plate being resiliently urged from said drill bit for expulsion of a ball from its seat for receipt by the receptacle by sufficient reduction of fluid pressure against the ball.

9. The tool of claim 8 wherein said second resilient means includes a sealed chamber enclosed between the tool body and reciprocal member adapted to receive a gas resiliently compressible by movement of the reciprocal member toward the drill bit.

10. A tool for use on a fluid conductive assembly, the tool having a tool body adapted to be mounted on the assembly in fluid transferring relation; means for performing a work operation borne on the tool body for movement along a path of travel extending to a position laterally disposed with respect to said tool body; and a reciprocal member received within the tool body for movement along a path substantially axially thereof and having an external cam surface engaging the performing means sloped in increments of increasing lateral distance from the axis of the reciprocal member whereby predetermined fluid pressure applied to said reciprocal member through a fluid conductive assembly upon which the tool is mounted causes predetermined movement of the reciprocal member and corresponding predetermined movement of said performing means along the path of travel.

11. The tool of claim 10 wherein the reciprocal member has an opening through which said fluid transferring relation is established with a fluid conducting assembly on which the tool is mounted and said tool includes an actuation member adapted selectively to be transported through said assembly for receipt in fluid obstructing relation to the opening to permit said predetermined fluid pressure to be applied to the reciprocal member and the actuation member.

12. The tool of claim 11 wherein the tool body has an internal receptacle laterally disposed with respect to said opening and adapted gravitationally to receive said actuating member from the opening when fluid pressure is reduced to a predetermined level fully to establish the fluid communication in the assembly through the tool.

13. The tool of claim 12 including a barrier borne on the tool body in a predetermined position in said path of movement of the reciprocal member by pins adapted to shear upon the application of predetermined pressure against said reciprocal member.

14. The tool of claim 13 wherein a pair of said tools are adapted to be mounted on a fluid conductive assembly, the reciprocal members of said tools having openings of different cross section and the tool having the opening of largest cross section mounted on the assembly above the other tool whereby the tools can be operated alternatively by transporting an actuating member through the assembly which is of a cross section to be received in the opening of the tool to be actuated.

* * * * *

UNITED STATES PATENT AND TRADEMARK OFFICE

CERTIFICATE OF CORRECTION

PATENT NO. : 3,974,886

DATED : August 17, 1976

INVENTOR(S) : Jack L. Blake, Jr.

It is certified that error appears in the above-identified patent and that said Letters Patent are hereby corrected as shown below:

In the title, delete "DIRECTIONAL DRILLING TOOL" and substitute ---TOOL FOR ACTUATION AT A REMOTE LOCATION FOR USE IN DIRECTIONAL DRILLING AND THE LIKE---.

Column 2, line 62, at the end of the line, delete "as" and substitute ---a---.

Column 5, line 68, delete "onto" and substitute ---into---.

Signed and Sealed this

Ninth Day of November 1976

[SEAL]

*Attest:*

RUTH C. MASON
*Attesting Officer*

C. MARSHALL DANN
*Commissioner of Patents and Trademarks*